US006609711B1

(12) United States Patent
Campbell

(10) Patent No.: US 6,609,711 B1
(45) Date of Patent: Aug. 26, 2003

(54) CASINO CARD GAME

(76) Inventor: Mark S. Campbell, 817 W. Euclid Ave., Spokane, WA (US) 99205

( * ) Notice: Subject to any disclaimer, the term of this patent is extended or adjusted under 35 U.S.C. 154(b) by 0 days.

(21) Appl. No.: 10/190,940

(22) Filed: Jul. 9, 2002

(51) Int. Cl.[7] ..... A63F 1/00
(52) U.S. Cl. ..... 273/274; 273/292
(58) Field of Search ..... 273/274, 292, 273/309; 463/12, 13

(56) References Cited

U.S. PATENT DOCUMENTS 5,395,120 A * 3/1995 Malek ..... 273/292
6,131,908 A * 10/2000 Palmer ..... 273/292
6,283,474 B1 * 9/2001 de Keller ..... 273/274
6,409,174 B1 * 6/2002 Demarest ..... 273/292
6,450,500 B1 * 9/2002 Miller ..... 273/292

* cited by examiner

*Primary Examiner*—William M Pierce
(74) *Attorney, Agent, or Firm*—Keith S. Bergman

(57) ABSTRACT

A gambling type card game for one or more players provides two probabilistically determined betting games both based on the same player hand of traditional playing cards. The first game simulates traditional black jack but with some different playing and counting rules and the second game simulates poker but with some different hand valuations and limited hand point values. Both game portions are individually bet on and both game portions are determined by pre-established valuations as opposed to comparison with a hand held by a casino-employed dealer or another player. Neither game portion outcome is related to the skill or knowledge of a dealer or of any other player but is determined probabilistically and by each player's play.

11 Claims, 1 Drawing Sheet

CASINO CARD GAME

II. BACKGROUND OF INVENTION

IIA. RELATED APPLICATIONS

Figure 1:
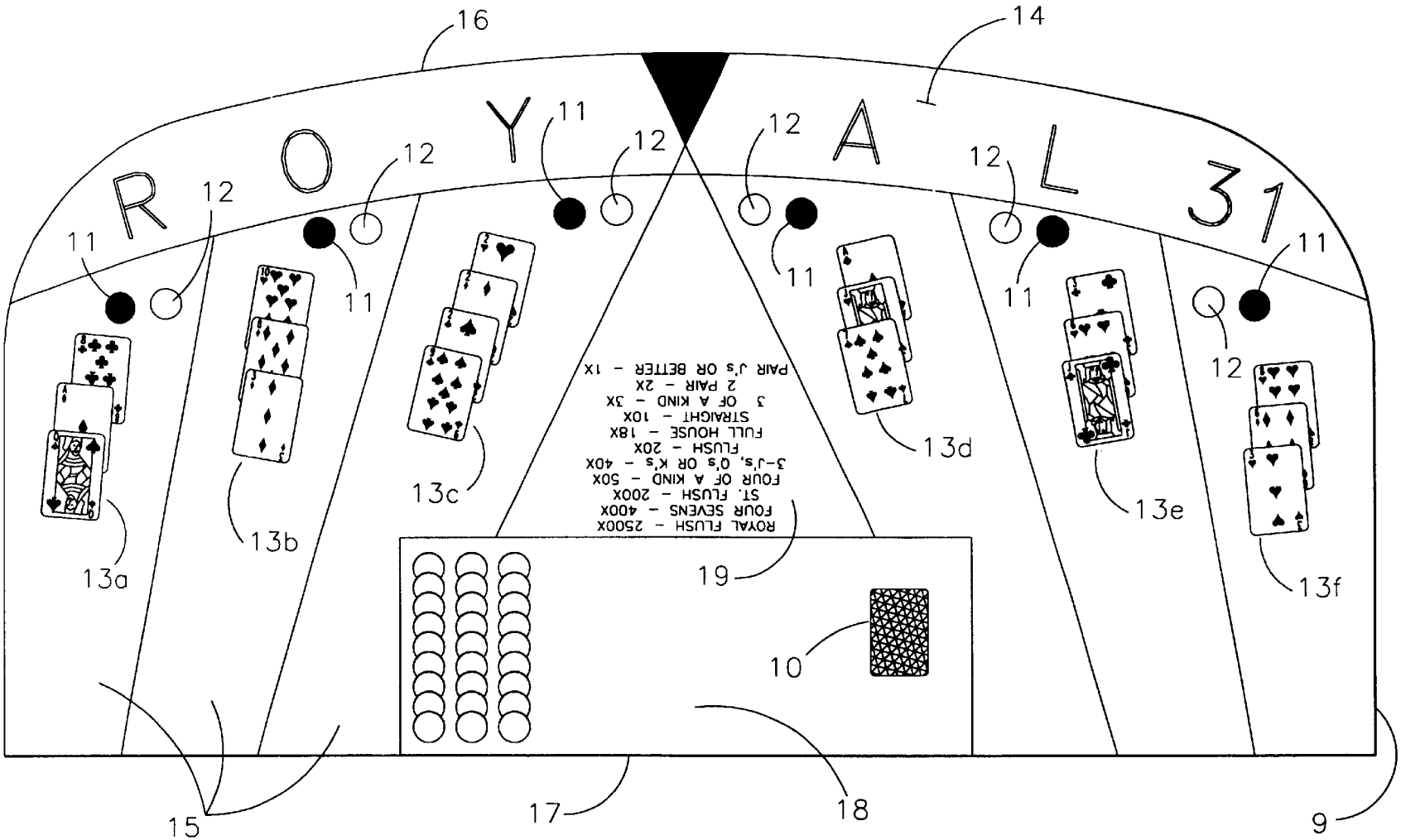

There are no applications for patent related hereto heretofore filed in this or any foreign country.

IIB. Field of Invention

My invention provides a casino-type card game that combines modified characteristics of a black jack game with modified characteristics of a poker game, both games simultaneously played pursuant to separate bets with a single card hand.

IIC. Background and Description of Prior Art

Gambling games have assumed increasing popularity and economic importance in the recent cultural past by reason of extinguishment of the historical aura of illegality that has previously surrounded gambling. This is especially true of casino-type gambling that has in recent years been embraced by many sovereigns to enhance their own coffers and in privately owned and operated for profit casinos which have come into being largely as a result of the approval of sovereign operated gambling. At the inception of the present gambling era, the gambling itself was sufficiently novel and enticing that it begot substantial public participation even though most of the casino gambling games were the same as, or variants of, ancient gambling games, some of which had been known since at least the fifteenth century. As time passed however, the early novelty began to wane and casinos have sought various inducements to maintain and enhance customer interest in their business.

One such type of inducement has been the creation and development of new, different and novel gambling games, and especially such games as do, or are perceived to, change and enhance the probabilities of a player's winning, or reduce or remove the effects that the skill and knowledge of professional gamblers associated with casinos may have upon the outcome of gambling games. The instant game seeks to fulfill this need by providing a new card game that yet remains within the essential ambit of known and habitually familiar card games of ancient origin, and one which removes casino employees' knowledge and skill as a factor affecting or determining game outcome.

The instant game accomplishes its ends by intimately blending modified elements of the traditional black jack game with modified elements of the traditional poker game, two of the world's most popular gambling games played with cards.

Both black jack and poker historically have had many and various versions, modifications and methods of play but the essence of each game is still well understood by many, if not most, gamblers.

Black jack, as presently known in U.S. gambling houses is in essence a version of the French game, vingt-et-un or "twenty-one", and that latter game in turn owes its organogenesis to the similar more ancient game of baccarat. The aim of baccarat, to acquire a total of playing pieces having value as near as possible to a given number, presently generally nine, without exceeding it, is a gambling principle known even before playing cards were invented. Black jack in its early history was usually played against a dealer or banker who was one of the group of game players and could be variously determined as play was instituted and proceeded. In modern day casino gambling the dealer or banker is usually an employee of the casino. Though the probability of winning is slightly higher for the dealer than for other players, skill and knowledge still are somewhat determinative of the outcome of the traditional black jack game. Since the casino dealer is, or is perceived to be, a professional gambler of substantial knowledge and skill, the present day casino black jack game, even when dealer play is partially or completely determined by house rules, is not looked upon with complete favor by casino patrons, and especially by those players that have, or perceive that they have, no substantial knowledge of the game.

In modern U.S. casino gambling the potential advantage of a skilled and knowledgeable dealer has generally been removed, or substantially removed, by house rules such as requiring the dealer to stand on a hand having a count of seventeen or more, but requiring the dealer to draw to a hand having a count of sixteen or less. Such rules, however, do not completely alleviate in the minds of all casino players the concept that the outcome of the game may be affected by the dealer's professional skill and knowledge of the game.

Poker is a quite ancient game with ancestral progenitors in Spain, Italy and France that appear in the literature as early as 1526, although those ancestral games were somewhat different from the modern U.S. casino forms of poker. Poker appeared as a gambling game in the United States at least as early as 1829 and was popularized in the modern U.S. form in England, and probably in Europe in general, in the 1870's by Queen Victoria who had a substantial liking of the game. The original game was played with three cards in its earlier European forms and card hands were ranked differently than in present day casino games. The number of cards in the poker hand increased to four in Europe in the 1700's and this begot the bluffing aspects of the game that continue into the present day with five or more cards in a hand. Poker probably better rewards the skillful player than any other card game and because of this, in present day casino gambling, the game is generally played between patrons without participation of house employees, except as non-playing dealers, because of the advantage that knowledgeable professional gamblers may have in the game. There are many variations of traditional poker games, but the common elements essential to game play and hand valuation remain substantially standardized in modern day casino gambling, at least in the English speaking world. Poker remains in the present day one of the most popular casino card games, notwithstanding or because of the importance of a player's skill in determining the game.

The instant game and its method of play blend various features of both black jack and poker to provide a single new game that is more probabilistically dependent than skill dependent to both attract customers and allow gambling houses to regulate profit margins of the game with reasonable accuracy by the application of mathematical probability theory.

The instant game differs from the traditional U.S. game of black jack by setting a maximum hand value of thirty-one rather than twenty-one, by assigning point values to cards that differ from traditional black jack point values and by determining bet payments based on predetermined point values of players' hands rather than by comparing players hands to a dealer's hand. The play of the game begins by dealing each player three cards and thereafter sequentially allowing each player to receive any additional number of cards desired until his hand exceeds thirty-one points or the player stands player three cards and thereafter sequentially allowing each player to receive any additional number of cards desired until his hand exceeds thirty-one points or the player stands on the hand he has. A player at any time may "double down" by making a second bet matching his first point value bet and thereupon receive one additional final card.

All of the player's bets are then evaluated. With the point value bet the instant game values the ten card with no point value, the other cards with traditional black jack values and pays hands one-to-one that have a total point value of twenty-nine, thirty or thirty-one points. If a player doubles down, a total point value of twenty-nine or thirty points in the player's hand pays one-to-one on both bets and a total point value of thirty-one points pays three-to-two.

After the point valuation the player's poker hand is evaluated when the total point value of the hand is not greater than thirty-one. The second poker bet is paid to the player if he has a poker hand with a pair of jacks or higher value. Poker hand values are determined by traditional U.S. poker valuation, except that three of the same value royal face cards (jacks, queens or kings) rank between a flush and four-of-a-kind; four sevens rank between a straight flush and a royal flush; and any flush or straight must contain five cards. The poker winnings of any particular hand are determined from a pre-established house established schedule with the pay out value of a particular hand generally varying substantially inversely with the probability of a player's obtaining that hand, as opposed to comparing the player's hand with hands of the other players or of a dealer. By use of this method of betting on poker hands there is no involvement of bluffing or the skill of a house dealer or of other players involved, to make the game probabilistically determinable. The outcome of the payouts of the poker game can be numerically estimated accurately by known mathematical probability theory to make the earnings of the game reasonably determinable by the gambling house.

My invention lies not in any one of these features per se but rather in the synergistic combination of all of the rules and methods of play of my game that necessarily give rise to the results flowing therefrom.

III. SUMMARY OF INVENTION

My invention provides a casino type card game that combines modified features of a black jack game and modified features of a poker game, both based on a single player hand. Both games are intimately related in the game play, but separate bets for each game type are made by the players for each game hand.

Each of a group of preferably from one to six players optionally making point value and optional poker bets are sequentially dealt a hand of three cards from one or more standard decks of fifty-two playing cards. Each player in turn may receive any additional number of cards he elects until he stands on the hand he then has or has surpassed a point total value of thirty-one, at which all of the player's bets are lost. The player may double down by making a second point value bet equal to the first point value bet and then receive only on additional card. The player's hand then, if still active, is evaluated for determination of all of the player's bets.

The point total bet valuation pays an equal amount of a player's bet on a hand having a point value of twenty-nine, thirty or thirty-one, with the playing cards having normal black jack values except for the ten card that has no point value. If a double down bet has been made the house pays an equal amount on both of the player's bets if the total hand value is twenty-nine or thirty and if the total hand value is thirty-one the house pays three-to-two on both player bets. If the player's hand exceeds thirty-one points the player loses all bets on both black jack and poker portions of the game.

After determination of the player's point value bets, and if a poker bet has been made, player's hand, if not over a point total of thirty-one, is then evaluated as a poker hand. Traditional U.S. poker valuations are used, except that three of the same rank of face cards have a valuation between a flush and four-of-a-kind; four sevens have a valuation between a straight flush and a royal flush; and a flush and a straight must contain five cards. The poker hand must have two jacks or a higher value to be eligible for bet payments, which are determined by a schedule, pre-established by the gaming house, with the payments varying substantially inversely with the probability of obtaining a particular poker hand.

In providing such a game and its method of play it is:

A principal object to provide a new casino type card game having modified features of a black jack game and modified features of poker game, all played with the same card hand.

A further object is to provide such a game that has different methods of play and valuation of hands than either the traditional black jack or poker games.

A further object is to provide such a game that intimately links the play of the black jack-like and poker-like portions of the game to each other, with separate but preferably equal bets made on each game portion.

A still further object is to provide such a game that is based on probabilistic determination rather than on the skill of the players to remove any advantage of a skilled and experienced player and to allow mathematical determination of the pay out of both the black jack and poker portions of the game.

A still further object is to provide such a game wherein winnings are determined by a pre-established house schedule rather than by comparison of one player's hand to the hands of other players or to a house dealer, who in the instant game is not a player.

A still further object is to provide such a game that is new and novel, of simple, easy and generally habitually familiar play and one otherwise well suited to the uses and purposes for which it is intended.

Other and further objects of my game will appear from the following specification and accompanying drawing which form a part hereof. In carrying out the objects of my invention however, it is to be understood that its features are susceptible of change in details, design, and ordering with only one preferred and practical embodiment being illustrated in the accompanying drawings and specified as is required.

IV. BRIEF DESCRIPTION OF DRAWINGS

In the accompanying drawing which form a part hereof and wherein like numbers of reference refer to similar parts throughout:

FIG. 1 shows a plan view of a table cover with cards and chips for the play of my game.

V. DESCRIPTION OF THE PREFERRED IMBODIMENT

My card game, designated as "Royal 31" for convenience of reference, is played with card deck 10 by players making point value bets 11 and poker bets 12 on each player hand 13. The game is preferably played by six players and a non-playing dealer, but it may be played by more or less players. The dealer normally is a non-playing gambling house employee, but the game can be played with one player acting as dealer. The dealer may have a probabilistic advantage over the other players though, so if a player is to be the dealer, the dealer position should pass periodically in some predetermined fashion, normally after each hand or a predetermined number of hands and traditionally in a clockwise direction to even the probabilities between all players.

Table cover 9 as shown in FIG. 1 is convenient but not necessary for play of Royal 31. The table cover 9 provides a playing surface 14 divided into six player areas 15, in the drawing numbered consecutively in a clockwise direction from one to six. The longer arcuate side 16 of the table cover 9 is the player's side and the elongate straight side 17 is the dealer's side which defines elongately medial inwardly extending dealer mat 18 and pay off schedule 19 indicating poker hand payoffs as determined by a particular gambling house.

Royal 31 is normally played with an ordinary deck of fifty-two playing cards consisting of four suits of thirteen cards each, with spot cards ranging from two through ten, face cards consisting of jack, queen and king and an ace. The game may be played by six or fewer players with one card deck, and may be played by more than six players with multiple decks of cards, usually at least one additional deck for each additional group or partial group of six players. The probabilities of the game will change with a number of decks of cards used to play it.

To play Royal 31 each player makes a point value bet and a poker bet. The poker bet may be made optional at a player's discretion by predetermined gambling house rules. After the making of the initial bet or bets by each player, the dealer sequentially deals three card hands to each player, preferably with the cards face up. It is possible to deal the three card hands face down, but if this is done the game becomes somewhat sequentially less probabilistic for later players because of knowledge of the cards that are already held by prior players.

To initiate play the player to receive the first card is determined by a probabilistic event such as the throw of a die or receipt of a card. The dealing then proceeds in a clockwise direction from the viewpoint of the dealer until all hands are dealt. In subsequent games by the same players the starting hand preferably moves one position in a clockwise direction after each game, but the starting player again may be determined for each game by some probabilistic event such as the throw of a die or receipt of a card. The dealer in Royal 31 normally has a slight probabilistic advantage over the players, so if the dealer be a player the deal is changed to remove this advantage from any single player. If a new player replaces an original player during game play, the new player assumes the same playing position as the player that was replaced.

Play commences with the player receiving the first card and proceeds in a clockwise direction. Each player in his turn may elect to stand on the hand dealt to him, may "double down" by indicating his election to do so, or may elect to sequentially receive any desired number of additional cards. To accomplish the double down play the player makes a second point total bet equal to the original point total bet already made and receives only one additional card face up from the dealer. The double down card is dealt face up, as its identity must be known to the dealer to allow determination of the point value of the player hand. The player's hand then is evaluated and that player's point total bet or bets paid by or lost to the dealer.

The point value of the player's hand is determined with the spot cards of two through nine having their face value, the face cards of jacks, queens and kings having a ten point value, the ace having a value of one or eleven at the option of the player and the ten cards having no value. A player who has not doubled down is paid one-to-one for a hand point total of twenty-nine, thirty or thirty-one points on the player's initial point total bet. A player that has doubled down and received one final card is paid on both point value bets one-to-one for a hand point total of twenty-nine or thirty and three-to-two for a hand point total of thirty-one. Any player's hand not having a point total of 29, 30 or 31 is lost to the dealer and any hand having a point total greater than thirty-one loses all of the player's bets, both on point total and poker, to the dealer at the point of play whereat the point total value exceeds thirty-one.

After determination of the players point total bet the hand is evaluated for determination of the poker bet. The player receives a payment from the dealer for any poker hand having a value of a pair of jacks or higher and looses the poker bet to the dealer on any hand having a lower value. The poker bet payment is to the player determined by multiplying the player bet by a multiple determined by a pre-established valuation schedule of multiples predetermined by the player or by in a non-casino setting gambling house in a casino setting, with values varying generally inversely with the probability of obtaining a particular poker hand. The valuation of poker hands in Royal 31 is similar to that of the traditional U.S. version of poker, with the exceptions that three face cards of equal rank are ranked between a flush and four-of-a-kind, and four sevens are ranked between a straight flush and a royal flush. Straights, flushes and straight flushes must contain five cards though other poker hand valuations not by their nature requiring five cards may be based on a poker hand of less than five cards. Poker hand valuations are allowed only on player hands that are not over a total point value of thirty-one points determined as in the point total portion of the game and the poker bet on any such hand over thirty-one points is forfeited to the gambling house at the time the hand value exceeds the point value of thirty-one. The poker bet is forfeited to the gambling house by any player having a poker hand that has a value lower than a pair of jacks.

The valuation schedule for various poker hands is predetermined by a particular group of players or by a gambling house playing Royal 31. Since the probabilities of obtaining particular poker hands may be mathematically determined by known methods, the pay out schedule of poker hands allows accurate determination by a gambling house of the probable cost of conducting the Royal 31 game and thusly allows fairly accurate mathematical determination of the gross profit received from the game, if the overall number of games played is reasonably large. The pay out schedule may be determined as seen fit by a particular gambling house.

A pay out schedule that makes pay outs to players approximately equal to the amount of player bets forfeited to the gambling house, a so-called "break even pay out" schedule, is set forth in Table 1:

TABLE 1

BREAK EVEN POKER PAY OUTS

| POKER HAND VALUE | BET PAY OFF MULTIPLE |
|---|---|
| Point value over thirty one | Player loses bet |
| Less than a pair of jacks | Player loses bet |
| Pair of face cards or aces | 1 to 1 |
| Two pair | 2 to 1 |
| Three of a kind of spot cards | 3 to 1 |
| Straight, five card | 15 to 1 |
| Full house | 20 to 1 |

TABLE 1-continued

| BREAK EVEN POKER PAY OUTS | |
|---|---|
| POKER HAND VALUE | BET PAY OFF MULTIPLE |
| Flush, five card | 25 to 1 |
| Three of a kind of face cards | 50 to 1 |
| Four of a kind | 60 to 1 |
| Straight flush, five card | 250 to 1 |
| Four sevens | 400 to 1 |
| Royal flush, five card | 2500 to 1 |

A suggested payout schedule that yields an approximately seven percent profit for the gambling house dealer is set forth in Table 2:

TABLE 2

| POKER PAY OUTS FOR APPROXIMATELY 7% CASINO PROFIT | |
|---|---|
| POKER HAND | BET PAY OFF MULTIPLE |
| Point value over thirty one | Player loses bet |
| Less than a pair of jacks | Player loses bet |
| Pair of face cards or aces | 1 to 1 |
| Two pair | 2 to 1 |
| Three of a kind of spot cards | 3 to 1 |
| Straight, five card | 10 to 1 |
| Full house | 18 to 1 |
| Flush, five card | 20 to 1 |
| Three of a kind of face cards | 40 to 1 |
| Four of a kind | 50 to 1 |
| Straight flush, five card | 200 to 1 |
| Four sevens | 400 to 1 |
| Royal flush, five card | 2500 to 1 |

It is to be noted from the forgoing description of Royal 31 that the pay out to players of the game may be mathematically determined and varied by modifying the valuation schedule determining the multiple amounts paid by the gambling house for particular poker hands. This feature of the game allows modification of pay out schedules to meet minimal pay out standards imposed by various sovereign authorities that regulate the operation of gambling houses in some jurisdictions. The probabilities of pay outs of Royal 31 may be modified to some degree by not exposing some or all of the cards dealt to individual players during the game play and determining hand values only after all cards have been dealt to all players. The game also may be made more probabilistic by using more decks of cards for the game play then are necessary or preferred as indicated herein.

It is also to be noted that the outcome of Royal 31 is determined completely by the cards initially and subsequently optionally dealt to a player, without any relationship to the skill or knowledge of gambling house employees or dealers, so that a player's winning or losing is not related to any standard determined by a dealer's hand or the method of play of a dealer or other players.

It is further to be noted that although the instant game is specified as being played in physical reality with actual playing cards, the game also may be played in a virtual environment of gaming machines having video imaging devices for cognizable output and mechanical betting apparatus of known nature. The adoption of Royal 31 to such game machines within the skill of a routiner in the gaming machine arts and application of my game to such gaming machines is within the ambit and scope of my invention.

The forgoing description of Royal 31 and its method of play are necessarily of a detailed nature so that specific embodiments of the game might be set forth as required, but it is to be understood that modifications of detail, rearrangement and multiplication of steps of the game play might be resorted to without departing from the spirit, essence or scope of the game.

Having thusly described my invention, what I desire to protect by letters patent, and

What I claim is:

1. A method for playing a gambling type card game by a dealer and at least one player that combines modified features of black jack type and poker type card games, comprising the steps of:

wagering a first point value bet and an optional second poker bet by each player;

dealing a three-card hand to each player by the dealer from at least one randomly arrayed deck of fifty-two playing cards;

allowing play by each player in turn to optionally receive any additional number of cards desired so long as the hand point value is less than thirty-two, said hand point value being calculated with spot cards of two through nine having their face value, the ten card having no value, face cards having a value of ten and aces having a value of one or eleven at the option of the player;

determining by the dealer the point value bet of the player, after each player's play, by paying the player one-to-one on a hand having a point total of twenty-nine, thirty and thirty-one, and by collecting by the dealer all other point value bets not paid and all poker bets if the hand value is greater than thirty-one;

if the point value of the poker hand is not greater than thirty-one determining by the dealer the poker hand value of the player based on values varying from a pair of at least jacks or higher, through two pairs, three spot cards of a kind, five card straight, full house, five card flush, three face cards of a kind, four cards of a kind except sevens, straight flush, four sevens, and royal flush, and paying by the dealer, the player's poker bet on hands, and having a poker value of at least a pair of jacks, with dealer payments determined by multiplying the player bet by a multiplier determined by a pre-established schedule, and collecting by the dealer all poker bets not paid by the dealer.

2. The method for playing the card game of claim 1 wherein:

each player during the player's play may optionally double down by electing to make a second point value bet equal to the first point value bet and receive only one additional card prior to determining the player's point value and poker bets.

3. The method of playing the game of claim 1 wherein the dealer is not a game player and remains the dealer throughout a period of game play.

4. The method for playing the card game of claim 1 wherein:

the dealer is not a game player while being the dealer;

a first dealer is chosen by a probabilistic event from the game players; and the dealer position passes to another player after each game pursuant to a predetermined sequence for succession of dealer position.

5. The method of playing the game of claim 1 wherein the predetermined schedule of payments for player poker hands provides approximately a seven percent advantage for the dealer and is sequentially:

| POKER HAND VALUE | MULTIPLES FOR BET PAY OFF |
|---|---|
| point value over thirty one | player loses bet |
| less than pair of jacks | player loses bet |
| pair of face cards or aces | 1 to 1 |
| two pair | 2 to 1 |
| three of a kind of spot cards | 3 to 1 |
| straight, five cards | 10 to 1 |
| full house | 18 to 1 |
| flush, five cards | 20 to 1 |
| three of a kind of face cards | 40 to 1 |
| four of a kind | 50 to 1 |
| straight flush, five cards | 200 to 1 |
| four sevens | 400 to 1 |
| royal flush, five cards | 2500 to 1 |

6. The method of playing the game of claim 1 wherein the predetermined schedule of payments for player poker hands provides approximately equal probabilities of winning by the dealer and by all players and is substantially:

| POKER HAND | BET PAY OFF |
|---|---|
| point value over thirty one | player loses bet |
| less than pair of jacks | player loses bet |

-continued

| POKER HAND | BET PAY OFF |
|---|---|
| pair of face cards | 1 to 1 |
| two pair | 2 to 1 |
| three of a kind of spot cards | 3 to 1 |
| straight, five cards | 15 to 1 |
| full house | 20 to 1 |
| flush, five cards | 25 to 1 |
| three of a kind face cards | 50 to 1 |
| four of a kind | 60 to 1 |
| straight flush, five cards | 250 to 1 |
| four sevens | 400 to 1 |
| royal flush, five cards | 2500 to 1 |

7. The method of playing the card game of claim 1 wherein the game is played with a single deck of fifty-two traditional playing cards by not more than six players.

8. The method of playing the game of claim 1 wherein the poker hand bet must be made by the player in the same amount as the point value bet.

9. The method of playing the game of claim 1 wherein the point value bet and the poker bet may be optionally made in any amounts.

10. The card game of claim 1 played sequentially by more than one player and wherein all player bets are made and all three-card hands dealt to each player before optional play to receive additional cards commences with the first player.

11. The card game of claim 1 played with multiple decks of traditional playing cards.

* * * * *